US006382910B1

(12) United States Patent
Kato et al.

(10) Patent No.: US 6,382,910 B1
(45) Date of Patent: May 7, 2002

(54) TURBINE EXPANSION MACHINE WITH VARIABLE NOZZLE MECHANISM

(75) Inventors: Takashi Kato, Hitachiota; Katsumi Kawano, Ibaraki-ken; Toru Shimba, Wako; Tadao Hiyama; Hiroshi Tsuji, both of Ibaraki-ken; Seiichiro Yoshinaga, Yokohama; Hiroshi Asakura, Tokyo; Nobuyoshi Saji, Kawaguchi; Takehiko Ishizawa, Fujimi, all of (JP)

(73) Assignees: Japan Atomic Energy Research Institute; Ishikawajima-Harima Heavy Industries Co., LTD, both of Tokyo (JP)

( * ) Notice: Subject to any disclaimer, the term of this patent is extended or adjusted under 35 U.S.C. 154(b) by 0 days.

(21) Appl. No.: 09/695,905

(22) Filed: Oct. 26, 2000

(30) Foreign Application Priority Data

Nov. 5, 1999 (JP) ..... 11-315040

(51) Int. Cl.[7] ..... F01D 17/12
(52) U.S. Cl. ..... 415/150; 415/160; 62/910
(58) Field of Search ..... 415/150, 160, 415/148, 159, 165, 166; 62/910, 6

(56) References Cited

U.S. PATENT DOCUMENTS 5,092,131 A * 3/1992 Hattori et al. ..... 62/6

FOREIGN PATENT DOCUMENTS

JP 3-72805 11/1991
JP 6-137101 5/1994
JP 06137101 A * 5/1994 ..... F01D/1/02

* cited by examiner

*Primary Examiner*—Edward K. Look
*Assistant Examiner*—Dwayne J. White
(74) *Attorney, Agent, or Firm*—Griffin & Szipl, P.C.

(57) ABSTRACT

An adiabatic expansion apparatus 22 with a built-in turbine impeller 12 adiabatically expands gas at a cryogenic temperature when the impeller rotates. A control device 24 is connected coaxially with the turbine impeller to control the impeller. A variable nozzle mechanism 30 is provided for varying the throat area for the gas at a cryogenic temperature to be introduced into the turbine impeller. The adiabatic expansion apparatus is installed in a vacuum vessel 14, and a control device is disposed outside the vacuum vessel. The variable nozzle mechanism comprises a nozzle component 32 built into the adiabatic expansion apparatus, and a driving component 34 installed outside the vacuum vessel. The nozzle component and the driving component are connected to the turbine impeller with a coaxial, thin cylindrical component 36, and drive the nozzle component when the cylindrical component rotates about the axis Z of the turbine impeller. The actuator and most of components of the nozzle driving mechanism can be installed at normal temperature under atmospheric pressure, the heat input can be suppressed to an extremely minimal level, and the variable nozzle of the expansion turbine can be driven. Thus, according to the invention, helium gas at a cryogenic temperature can be expanded adiabatically at a high adiabatic efficiency.

6 Claims, 5 Drawing Sheets

TURBINE EXPANSION MACHINE WITH VARIABLE NOZZLE MECHANISM

FIELD OF THE INVENTION

The present invention relates to a turbine expansion machine equipped with a variable nozzle mechanism.

BACKGROUND OF THE INVENTION

A turbine expansion machine is used to increase the thermal efficiency of a helium refrigerator, and a variable nozzle drive mechanism is proposed to vary the capacity of the turbine expansion machine (see, for example, Japanese Patent No. 72805/1991 and unexamined Japanese Patent Publication No. 137101/1994).

The expansion turbine variable-nozzle drive apparatus of Japanese Patent No. 72805/1991 is, as shown in FIG. 1, provided with a rod 9 that can move linearly and is equipped with a junction portion 9*a* configured with a knob 8*a* disposed on the outer periphery of a movable ring 8. The knob 8*a* has an arched, elevated surface in both directions of the rod's movement, and a grooved surface is provided on junction portion 9*a* that can engage with the arched surfaces of the knob. In FIG. 1, part numbers show a main unit of an expansion turbine as 1, an air cylinder as 2, a nozzle drive apparatus as 3, a nozzle fixing ring as 4, a variable nozzle as 5, a fixing pin as 6, and a movable pin as 7. By rotating variable ring 8, movable pin 7 is driven circumferentially, whereby the angle of variable nozzle 5 is varied.

The variable nozzle-type expansion turbine according to the unexamined Japanese patent publication No. 137101/1994 is comprised of, as shown in FIG. 2, a main shaft 11 at one end of which a turbine impeller 12 is disposed and at the other end of which a brake fan 13 is mounted. Main shaft 11 is supported by a journal bearing and a thrust bearing. The turbine impeller 12 is installed outside a vacuum refrigerating tank 14 (vacuum vessel) to which the casing 15 of the expansion turbine is fixed.

In the above-mentioned conventional turbine expansion machine and its variable nozzle drive mechanism, nozzle drive apparatus 3 for driving variable nozzle 5 is arranged at a normal-temperature portion outside vacuum vessel 14, a low-temperature portion is enclosed with a heat insulation material, and a nozzle drive plate (movable ring 8 ) is driven. However, one problem affecting the machine and the mechanism disclosed is the ingress of excessive heat into the low-temperature portion.

More explicitly, in the above-mentioned examples, the main unit 1 of the expansion turbine (or a casing 15 of the expansion turbine) is installed in the normal-temperature portion, inside of which the turbine impeller 12 is assembled to adiabatically expand helium. Therefore, when the helium gas at a cryogenic temperature (for instance, 7~9K) is expanded adiabatically at the turbine impeller 12, the gas is heated by heat entering from the main unit of the expansion turbine 1, so the adiabatic efficiency of the turbine expansion machine deteriorates, which is a practical problem.

To solve these problems, it is also possible to install in the cryogenic temperature portion in the vacuum vessel all of main unit 1 of the expansion turbine, nozzle drive apparatus 3, variable nozzle 5, movable ring 8, turbine impeller 12, etc., thereby heat-insulating them from the outside, normal-temperature region. However, the mechanical portion of nozzle drive apparatus 3 becomes difficult to maintain and an actuator (motor or pneumatic cylinder) of nozzle drive apparatus 3 must be specially structured to withstand operations at a cryogenic temperature and in a vacuum environment. Therefore, maintenance becomes very difficult and the cost of the system is extremely high.

SUMMARY OF THE INVENTION

The present invention aims to solve these problems. That is, an object of the present invention is to provide a turbine expansion machine with a variable nozzle mechanism wherein most of the actuator and the nozzle drive mechanism can be installed in the normal-temperature range at atmospheric pressure, heat input can be suppressed to the extremely minimal level while driving the variable nozzle of the expansion turbine, whereby helium gas at a cryogenic temperature can be expanded adiabatically at a high adiabatic efficiency.

In accordance with a preferred embodiment of the present invention, there is provided a turbine expansion machine with variable nozzle mechanism. The machine comprises a vacuum vessel, an adiabatic expansion apparatus, a control device and a variable nozzle mechanism. The adiabatic expansion apparatus is disposed in the vacuum vessel, and includes a turbine impeller having an axis wherein the impeller is arranged to adiabatically expand gas when rotated. The control device is disposed outside the vacuum vessel, and operably connected coaxially with the turbine impeller to control the impeller. The variable nozzle mechanism defines a variable throat area for gas introduced into the turbine impeller. The variable nozzle mechanism further comprises a nozzle component disposed in the adiabatic expansion apparatus, a driving component installed outside the vacuum vessel, and a coaxial, thin cylindrical component, operably connecting the nozzle component and the driving component to the turbine impeller, wherein the nozzle component is driven by rotating the cylindrical component about the axis of the turbine impeller.

According to another embodiment of the present invention, a turbine expansion machine is provided with a variable nozzle mechanism comprising a built-in turbine impeller (12), an adiabatic expansion apparatus (22) that adiabatically expands gas at a cryogenic temperature when the impeller rotates, a control device (24) that is connected coaxially with the turbine impeller and controls the impeller, and a variable nozzle mechanism (30) that changes the throat area of the gas at cryogenic temperature to be introduced into the turbine impeller. The adiabatic expansion apparatus is installed in vacuum vessel (14), the control device is equipped outside the vacuum vessel, the variable nozzle mechanism is composed of nozzle component (32) built into the adiabatic expansion apparatus and drive component (34) disposed outside the vacuum vessel. The nozzle component and the drive component are connected to the turbine impeller with a coaxial thin cylindrical component (36), and the nozzle component is driven by the cylindrical component when it swings around the axis of the turbine impeller.

According to the configuration of the present invention, because the adiabatic expansion apparatus (22) with turbine impeller (12) is installed in vacuum vessel (14), heat input can be suppressed to a minimum due to vacuum heat insulation. Since control device (24), which controls the turbine impeller, is arranged outside the vacuum vessel, the control device can be easily maintained. Furthermore, the variable nozzle mechanism (30), which varies the throat area of the turbine impeller, is composed of nozzle component (32) incorporated inside the adiabatic expansion apparatus and drive component (34) installed outside the vacuum vessel. Because the nozzle component (32) and the drive component (34) are connected with thin cylindrical component (36) which drives the nozzle component, the cylindrical component can be made thin enough to drive the nozzle component (for example, about 0.5 mm thick), so that the amount of heat transmitted from the cylindrical component can be reduced to the extremely minimal level. Consequently, most of the actuator and the nozzle drive mechanism can be installed in a normal-temperature environment at atmospheric pressure and heat input can be kept extremely low, and the variable nozzle of the expansion turbine can be driven. Thereby helium gas at a cryogenic temperature can be expanded adiabatically at a high adiabatic efficiency.

According to a further preferred embodiment of the present invention, the aforementioned nozzle component (32) comprises a plurality of movable nozzle plates (38) disposed around the turbine impeller (12) and supported by supporting pins (37) in a movable manner, and a driving circular disk (39), which is connected to the above-mentioned cylindrical component (36), and also to each movable nozzle plate by means of a drive pin (39*a*), wherein the aforementioned driving component (34) is configured with a large gear (40) that is connected to the outer periphery of the above-mentioned cylindrical component (36) and can turn around the axis of the turbine impeller, and a rotary drive device (42) that rotates and drives a small gear (41) engaged with the large gear.

Using this configuration, cylindrical component (36) can be adjusted about the axis of the turbine impeller by rotary driving device (42) via small gear (41) and large gear (40), thus driving circular disk (39) is also controlled, movable nozzle plate (38) is driven to turn, and the throat area of the variable nozzle can be varied continuously.

The aforementioned rotary driving device (42) is a pulse motor, and preferably should be provided with a position detection sensor (43) for detecting the rotary limit of large gear (40). In this configuration, the reference position of variable nozzle (38) is detected by position detection sensor (43), and the swing angle of driving circular disk (38) from the reference position is precisely determined by the pulse motor, so that the variable nozzle can be accurately positioned.

The above-mentioned adiabatic expansion apparatus (22) is connected to control device (24) by means of inner cylindrical component (25*a*), outer cylindrical component (25*b*) and cylindrical component (36). The inner and outer surfaces of cylindrical component (36) are sealed by sealing components (44*a*, 44*b*), respectively, in a slidable manner. In this configuration, heat input from a portion maintained at a normal temperature into adiabatic expansion apparatus (22) can be suppressed to a minimal level by outer cylindrical component (25*b*), inner cylindrical component (25*a*), and inner heat insulation component (23). The sealing components (44*a*, 44*b*) can prevent the flow of heat from low-temperature impeller (12) to the normal-temperature side through gaps between inner cylindrical component (25*a*) and cylindrical component (36) and between inner heat insulation component (23) and cylindrical component (36). Therefore, ingress of heat can be prevented.

The above-mentioned control device (24) should preferably be a generator or a compressor impeller. When a generator is used for control purposes, the energy loss produced during adiabatic expansion can be collected as electric power. When a compressor impeller is used for control purposes, energy loss at this time can be recovered as a pressurized gas.

These and other objects and advantages of the present invention will become more readily appreciated and understood from a consideration of the following detailed description of the preferred embodiments when taken together with the accompanying drawings.

DESCRIPTION OF THE PREFERRED EMBODIMENTS

Figure 1:
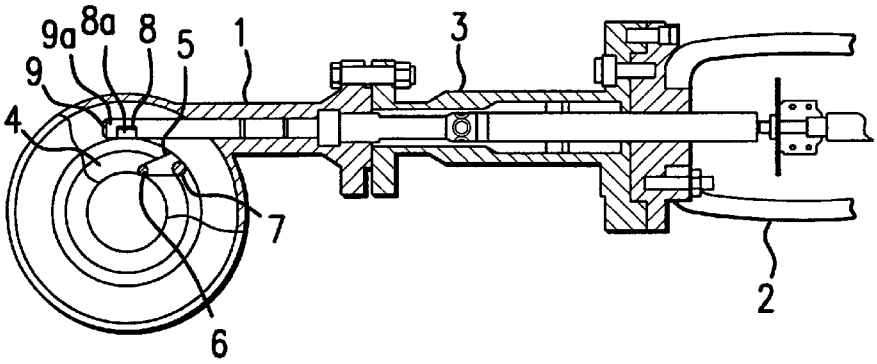
FIG.1 PRIOR ART
FIG. 1 shows the configuration of a conventional variable nozzle driving mechanism.
Figure 2:
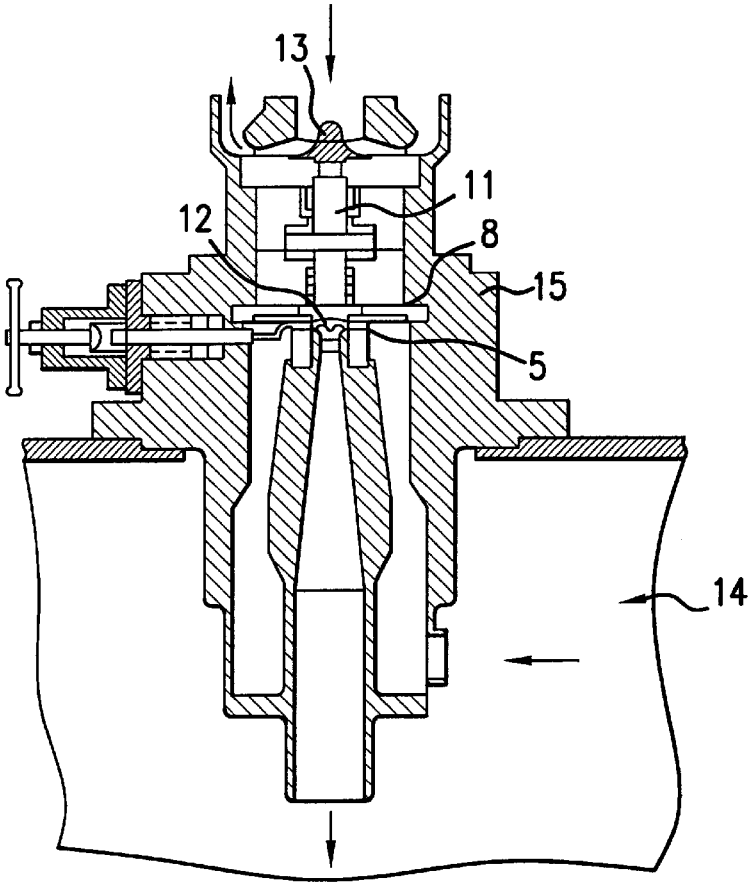
FIG.2 PRIOR ART
FIG. 2 is a view of a configuration of a conventional turbine expansion machine.

The preferred embodiments of the present invention are described below referring to the drawings. In each drawing, common parts are numbered identically, and no duplicate description is given.

Figure 3:
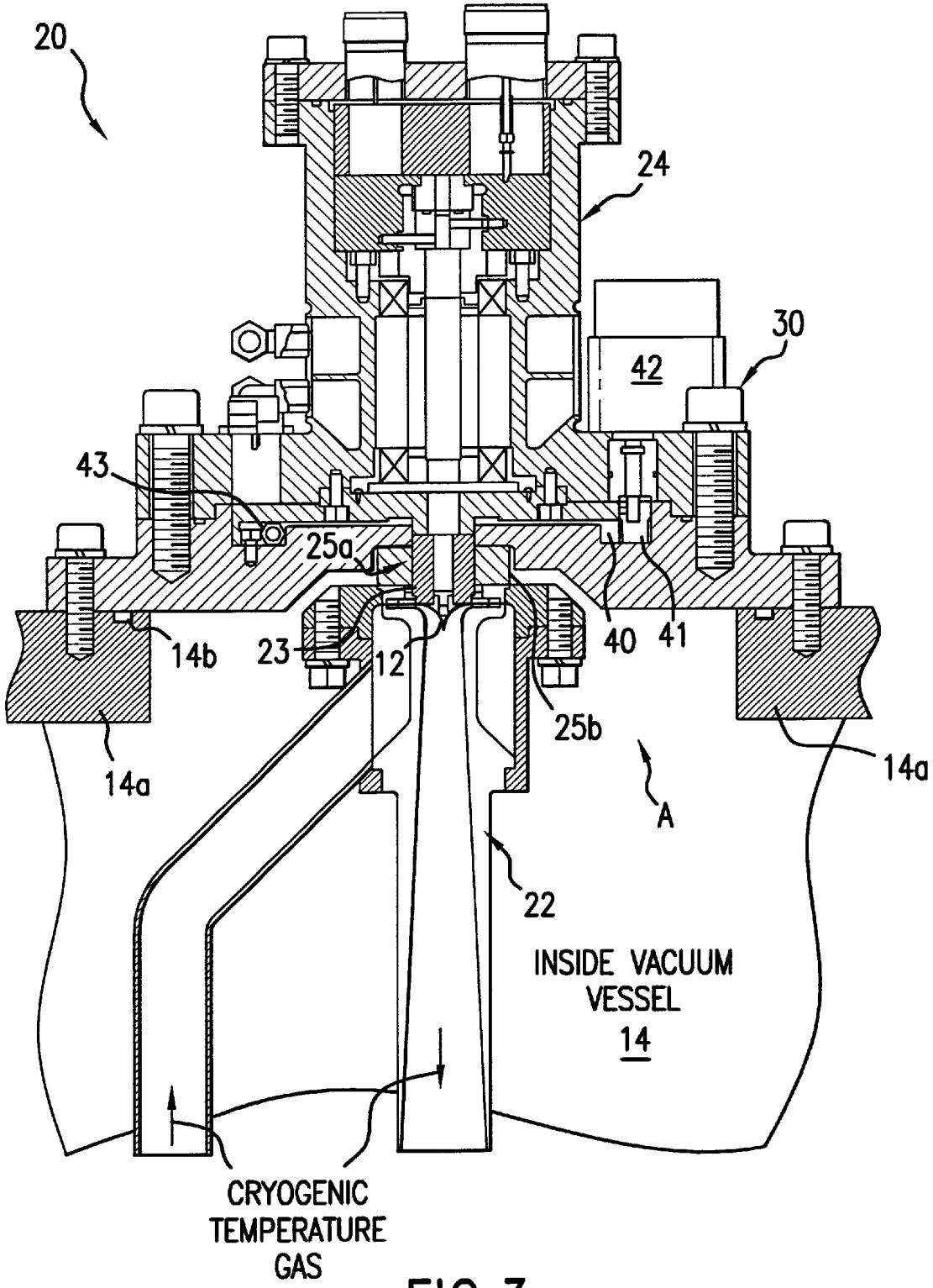
FIG. 3 is a general configuration view of a turbine expansion machine according to the present invention.

FIG. 3 is the general configuration view of a turbine expansion machine according to the present invention. In this figure, turbine expansion machine 20 with a variable nozzle mechanism according to the present invention comprises an adiabatic expansion apparatus 22, a control device 24, and a variable nozzle mechanism 30.

The adiabatic expansion apparatus 22 is installed in vacuum vessel 14. The adiabatic expansion apparatus 22 is provided with a built-in turbine impeller 12, and when the impeller rotates, gas at cryogenic temperature (for instance, helium gas at 7~9K) is expanded adiabatically.

The control device 24 is installed on an outer wall 14*a* of the vacuum vessel 14 via sealing component 14*b*, and is located outside the vacuum vessel 14. The control device 24 is an induction motor generator in this example, connected to the turbine impeller 12 coaxially, and brakes the impeller. The control device 24 is not limited only to an induction motor generator, but can be a compressor impeller, for example.

Figure 4A:
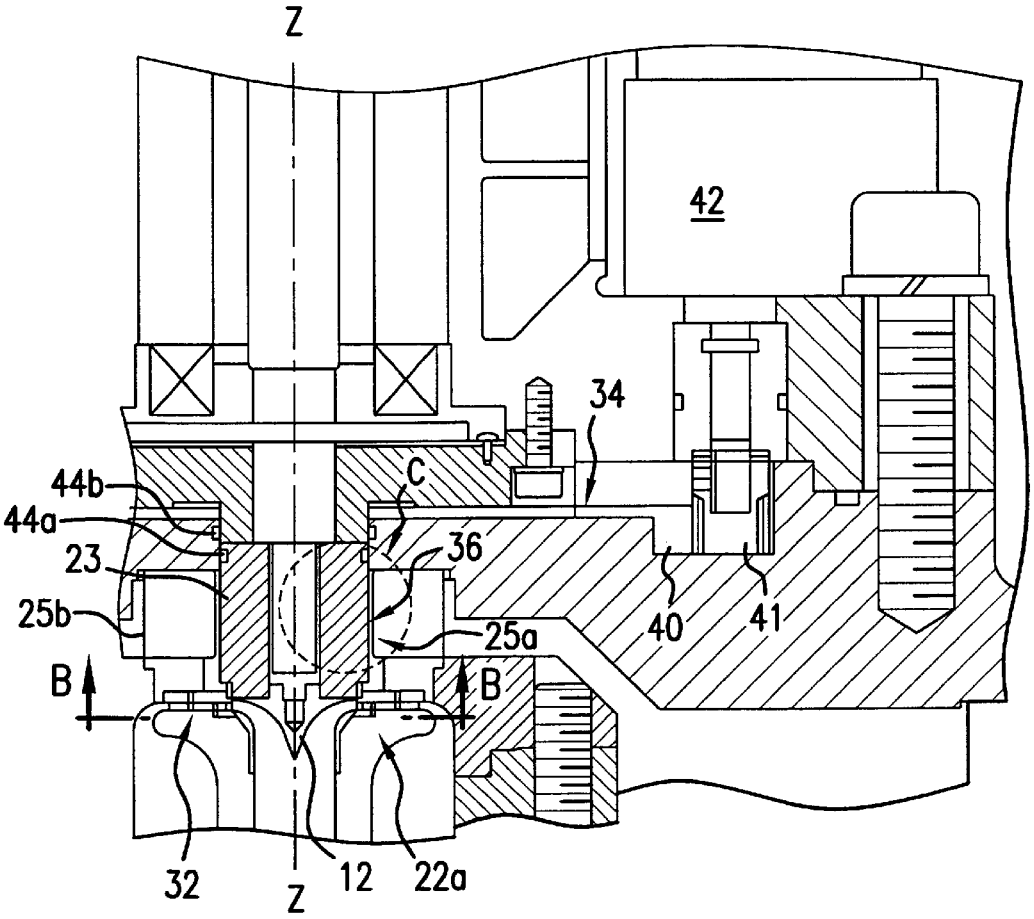
FIG. 4A is an enlarged view of Part A in FIG. 3.
Figure 4B:
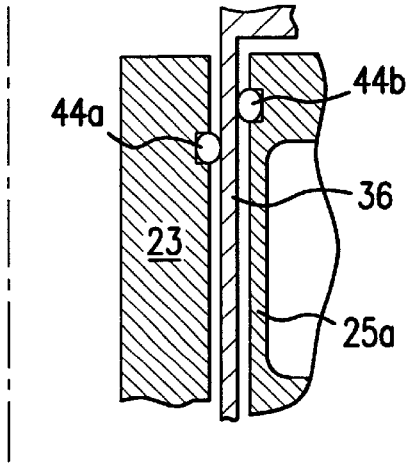
FIG. 4B is an enlarged view of Part C in FIG. 4A.
Figure 5:
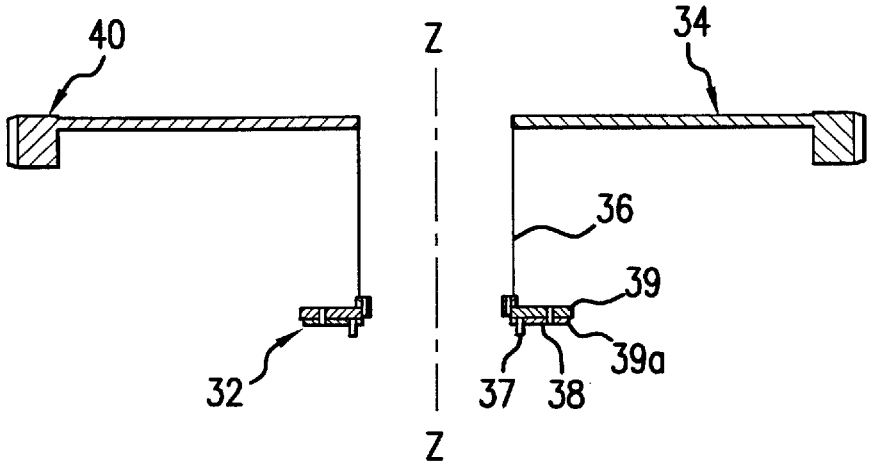
FIG. 5 is a drawing of the driving system in FIG. 4.

FIG. 4A is an enlarged view of Part A in FIG. 3, and FIG. 4B shows enlarged Part C in FIG. 4A. FIG. 5 is a view describing the driving system in FIG. 4A, and FIG. 6 is a view along line B—B in FIG. 4A.

As shown in FIGS. 4A, 4B and 5, the variable nozzle mechanism 30 comprises a nozzle component 32 built into adiabatic expansion apparatus 22, and a driving component 34 installed outside the vacuum vessel 14. The nozzle component 32 and driving component 34 are connected to the turbine impeller 12 with a coaxial, thin cylindrical component 36.

Figure 6:
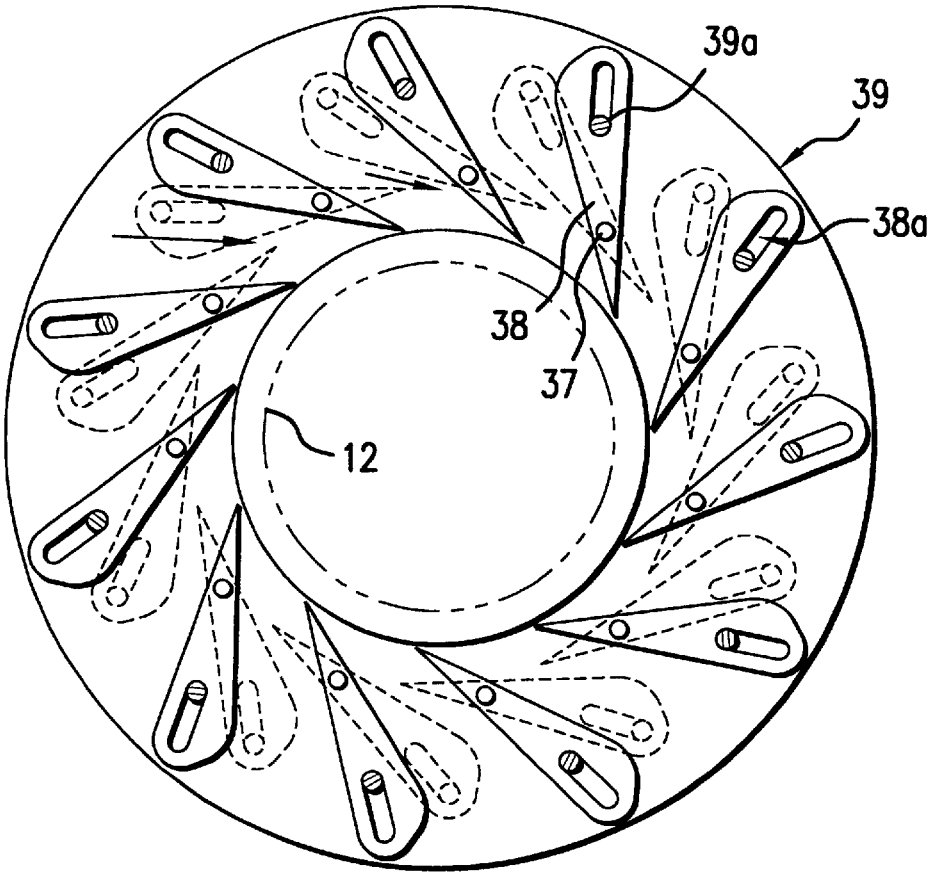
FIG. 6 is the view along line B—B in FIG. 4.

As shown in FIGS. 5 and 6, the nozzle component 32 is configured with a plurality of movable nozzle plates 38 (11 plates in this example) arranged around turbine impeller 12, and a driving circular disk 39 connected to each movable nozzle plate 38 with a driving pin 39*a*. Each movable nozzle plate 38 is provided with a long slot 38*a*, with which the driving pin 39*a* loosely engages. Each movable nozzle plate 38 is supported by a supporting pin 37 fixed to a main unit 22*a* of the adiabatic expansion apparatus 22 such that the plate can turn about the supporting pin 37. Driving circular disk 39 is, as shown in FIG. 5, connected to an inner periphery of the cylindrical component 36 using, in this example, a plurality of pins.

According to the above-mentioned configuration shown in FIG. 6, the thin cylindrical component 36 is turned about the axis Z of turbine impeller 12, whereby the variable nozzle plate 38 can be adjusted around the supporting pin 37 from the position of the solid lines to the location of the fine lines, so that the throat area of a gas at a cryogenic temperature is changed and the gas is introduced into the turbine impeller 12.

As shown in FIGS. 3 to 5, the driving component 36 comprises a large gear 40 connected to an outer periphery (upper end in this figure) of the cylindrical component 36 and a rotary driving device 42, which drives and rotates a small gear 41 in engagement with the large gear 40. The large gear 40 is constructed to be rotatable around the axis Z of the turbine impeller 12. In addition, a position detection sensor 43 for detecting the rotary limit of the large gear 40 is assembled by cutting away part of an outer periphery of the large gear. Although the rotary driving device 42 is a pulse motor in this example, it can also be another rotary driving means.

Using this configuration, the cylindrical component 36 is rotated about the axis Z of the turbine impeller 12 via small gear 41 and large gear 40, by means of the rotary driving device 42. Thereby the driving circular disk 39 is rotated as shown in FIG. 6, and movable nozzle plates 38 are driven and adjusted around respective supporting pins 37, so that the throat area of the variable nozzle formed by the movable nozzle plates 38 can be adjusted continuously. The position detection sensor 43 detects the reference position of the variable nozzle plate 38, and the adjustable angle of the driving circular plate 39 from the reference position is precisely determined, thus the variable nozzles can be accurately located.

As shown in FIGS. 3 and 4, the adiabatic expansion apparatus 22 is connected to control device 24 by means of the inner cylindrical component 25*a*, the outer cylindrical component 25*b*, the cylindrical component 36, and the inner heat insulation component 23. Inner and outer surfaces of the cylindrical component 36 are sealed slidably by the sealing components 44*a*, 44*b*.

According to the aforementioned configuration of the present invention, because the adiabatic expansion apparatus 22 with the built-in turbine impeller 12 is installed inside the vacuum vessel 14, the ingress of heat can be minimized due to vacuum heat insulation. Since the control device 24 for the turbine impeller 12 is disposed outside vacuum vessel 14, control device 24 can be easily maintained.

Furthermore, the variable nozzle mechanism 30 for varying the throat area of the turbine impeller 12 comprises a nozzle component 32 incorporated in the adiabatic expansion apparatus 22 and a driving component 34 arranged outside the vacuum vessel, is connected to the nozzle component 32 using a thin, cylindrical component 36 and drives the nozzle component. The cylindrical component 36 can be made as thin as required for driving the nozzle component (for instance, about 0.5 mm thick), so the heat transmitted from the cylindrical component 38 can be reduced to an extremely minimal level.

Therefore, the actuator and most of the nozzle driving mechanism can be installed in a region with normal temperature and atmospheric pressure; moreover, the heat input can be suppressed to an extremely minimal level, and the variable nozzle of an expansion turbine can be driven, thus helium gas at a cryogenic temperature can be expanded adiabatically at a high adiabatic efficiency.

EXPERIMENT

The inventors of the present invention manufactured the turbine expansion machine 20 with the above-mentioned variable nozzle mechanism according to the present invention, and tested the performance of the machine. Table 1 shows the basic specifications of the turbine expansion machine manufactured, and FIG. 7 shows the results of the performance test on the turbine expansion machine according to the present invention.

TABLE 1

| | |
|---|---|
| Inlet pressure | 16 atm |
| Outlet pressure | 4 atm |
| Rate of flow | Rating 500 g/s |
| Revolution speed | Rating 75,000 rpm (Maximum 85,000 rpm) |
| Impeller | Diameter 24 mm (Francis water-turbine type) |
| Bearing | Dynamic pressure gas bearing |
| Braking system | Induction motor generator |
| Capacity adjustment | Variable nozzle mechanism (pulse motor driven) |
| Adiabatic efficiency | 65% or more |

Figure 7:
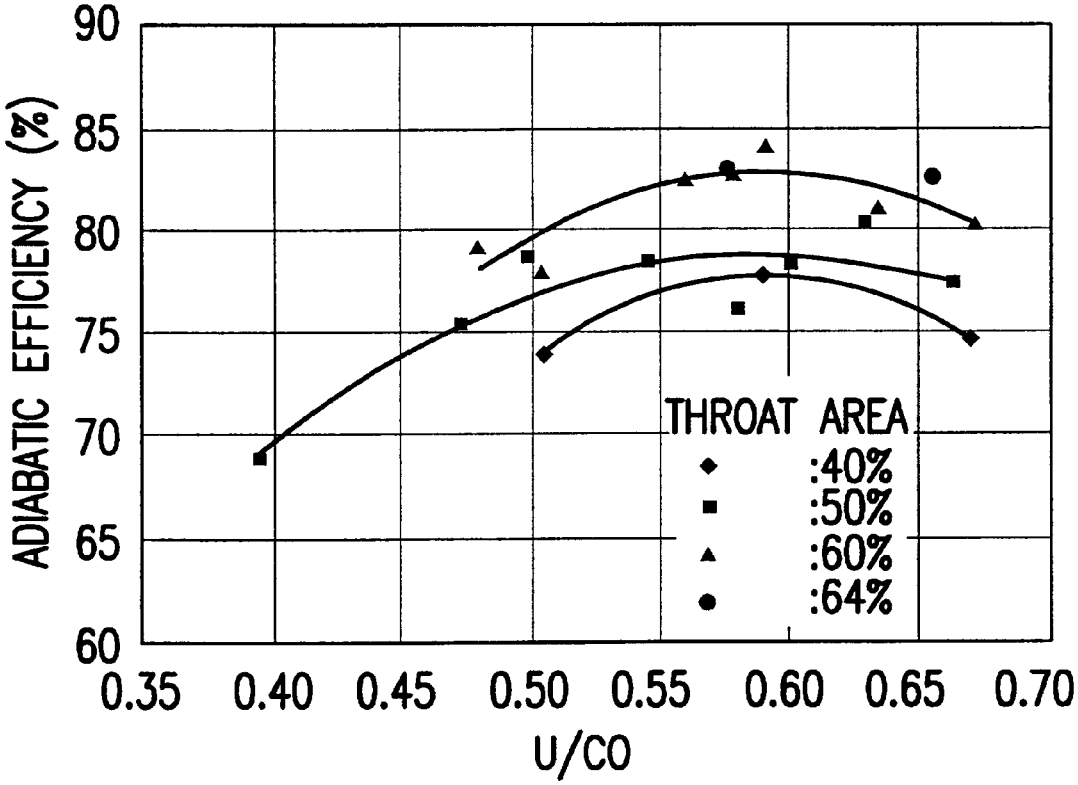
FIG. 7 shows the results of a performance test of the turbine expansion machine according to the present invention.

Obviously from FIG. 7, the following facts were confirmed according to this performance test.

(1) The maximum adiabatic efficiency reached was about 84%. Therefore, a high-efficiency, super-critical-pressure helium turbine has been developed.

(2) Although the test was performed up to a throat area of about 64% for the variable nozzle, the maximum adiabatic efficiency (about 84%) was achieved at this maximum throat area. Therefore, a higher adiabatic efficiency can possibly be achieved by setting the degree of opening higher.

(3) Using the turbine expansion machine with the variable nozzle mechanism according to the present invention, the generator can recover energy, so that the capability of a helium refrigerating machine incorporating the present invention can be enhanced beyond that of the prior art. That is, according to the present invention, the efficiency of the turbine is increased; therefore, the efficiency of the helium refrigerating system using this turbine is also increased.

As described above, the turbine expansion machine with the variable nozzle mechanism according to the present invention incorporates an actuator and most components of the nozzle driving mechanism that can be installed in a normal-temperature range under atmospheric pressure, while also suppressing the heat input to an extremely small value when driving the variable nozzle of the expansion turbine, thus, helium gas at a cryogenic temperature can be expanded adiabatically at a high adiabatic efficiency. These effects are excellent in practice.

Although the present invention has been described referring to several preferred embodiments, it should be understood that the scope of rights included in the present invention should not be limited only to these embodiments. To the contrary, the scope of rights of the present invention should include all improvements, corrections, and equivalent entities covered by the scope of the attached claims.

What is claimed is:

1. A turbine expansion machine with variable nozzle mechanism, comprising:

a vacuum vessel;

an adiabatic expansion apparatus, disposed in the vacuum vessel, including a turbine impeller having an axis, the impeller being arranged to adiabatically expand gas when rotated;

a control device, disposed outside the vacuum vessel, and operably connected coaxially with the turbine impeller to control the impeller; and a variable nozzle mechanism defining a variable throat area for gas introduced into the turbine impeller, the variable nozzle mechanism further comprising a nozzle component disposed in the adiabatic expansion apparatus, a driving component installed outside the vacuum vessel, and a coaxial, thin cylindrical component, operably connecting the nozzle component and the driving component to the turbine impeller, wherein the nozzle component is driven by rotating the cylindrical component about the axis of the turbine impeller.

2. The turbine expansion machine according to claim 1, wherein said thin cylindrical component has an inner peripheral end and an outer peripheral end;

wherein said nozzle component comprises a driving circular disk operably connected to the inner peripheral end of said thin cylindrical component, a plurality of movable nozzle plates disposed around the turbine impeller, a plurality of supporting pins rotatably supporting the nozzle plates on the driving circular disk, and a driving pin operably connecting each movable nozzle plate to the driving circular disk; and wherein said driving component comprises a large gear operably connected to the outer peripheral end of the said cylindrical component and rotatable about the axis of the turbine impeller, a small gear engaged with the large gear and a rotary driving apparatus operably connected to drive the small gear.

3. The turbine expansion machine according to claim 2, wherein the said rotary driving device is a pulse motor and, the variable nozzle mechanism further comprises a position detection sensor which detects an angular limit of rotation of the large gear.

4. The turbine expansion machine according to claim 1, further comprising elements operably connecting said adiabatic expansion apparatus to the control device, said elements including:

an inner cylindrical component, an outer cylindrical component, and an inner heat insulation component; and wherein said cylindrical component further comprises inner and outer surfaces sealed by a plurality of slidable sealing components.

5. The turbine expansion machine according to claim 1, wherein said control device is a generator.

6. The turbine expansion machine according to claim 1, wherein said control device is a compressor impeller.

* * * * *